US012576326B2

(12) United States Patent
Stein

(10) Patent No.: US 12,576,326 B2
(45) Date of Patent: Mar. 17, 2026

(54) GOLF PRACTICE DEVICE

(71) Applicant: Eagle i Align LLC, Jupiter, FL (US)

(72) Inventor: Dylan Stein, Jupiter, FL (US)

( * ) Notice: Subject to any disclaimer, the term of this patent is extended or adjusted under 35 U.S.C. 154(b) by 715 days.

(21) Appl. No.: 17/985,343

(22) Filed: Nov. 11, 2022

(65) Prior Publication Data

US 2024/0157219 A1 May 16, 2024

(51) Int. Cl.
*A63B 69/36* (2006.01)
*A63B 71/06* (2006.01)

(52) U.S. Cl.
CPC .. *A63B 69/3676* (2013.01); *A63B 2071/0694* (2013.01); *A63B 2214/00* (2020.08); *A63B 2225/093* (2013.01)

(58) Field of Classification Search
CPC . A63B 69/36; A63B 69/3676; A63B 69/3623; A63B 69/3629; A63B 69/3682; A63B 71/023; A63B 69/3661; A63B 2225/12; A63B 2225/093; A63B 2225/09
See application file for complete search history.

(56) References Cited

U.S. PATENT DOCUMENTS 5,665,007 A 9/1997 Tatum
6,004,230 A 12/1999 Hooker
9,861,873 B1 1/2018 Davis
2005/0261077 A1 11/2005 Kim
2009/0227385 A1* 9/2009 Crealese ..... A63B 69/3629 473/218
2013/0231199 A1 9/2013 Stockton
2019/0255415 A1 8/2019 Helmker
2022/0134207 A1 5/2022 Walker

FOREIGN PATENT DOCUMENTS

CA 2414716 A1 * 6/2004 ..... A63B 69/3682
WO WO-2016154671 A1 * 10/2016 ..... A63B 71/023
WO WO-2017179884 A1 * 10/2017 ..... A63B 69/3623
WO WO-2023210603 A1 * 11/2023 ..... A63B 69/3676

* cited by examiner

*Primary Examiner* — David L Lewis
(74) *Attorney, Agent, or Firm* — Mitchell J. Mehlman, Esq.

(57) ABSTRACT

A golf practice is provided. The device includes a base, a target support structure, a positioner, and, a target. The target support structure can include a groove. The positioner can slidably engage the groove to allow the target support structure to be adjusted to a plurality of vertical positions. The positioner includes a slot in which the target is mounted. The target can include a bullseye. The device can be configured to a position wherein a user's eye is substantially colinear with the bullseye and with a golf ball as seen from above by the user, thus allowing the user to practice various golf swings while maintaining their head and eye(s) in a consistent position relative to the golf ball.

20 Claims, 5 Drawing Sheets

GOLF PRACTICE DEVICE

FIELD OF THE INVENTION

The present invention relates generally to devices used for practicing a golf stroke. In particular, the present invention can be used as a golf training aid to help golfers of all skill levels, including both amateur and professional, achieve proper alignment during practice. This device does not impact the ground thus no holes or other damage will result in the putting surface or other practice area where the device is used.

BACKGROUND

Golfer's frequently practice putting and other types of golf strokes using, for example, a putter, an iron, or a wood. The position of the golf ball in relation to the golfer's eye is a critical factor in achieving optimum contact between the club face and the golf ball and thereby executing an accurate shot in both distance and direction.

U.S. Pat. No. 5,665,007 ("Tatum") discloses a golf putting training device attached to the shaft of a putter has a shape that extends out from the shaft and forms an elongated edge that is aligned by a user along the heel of the putter so that a spacing is formed between the edge and a golf ball adjacent the putter head face at address. The user moves the putter head along the putting stroke so that the spacing is maintained essential constant throughout the stroke thereby ensuring the putter head face is maintained perpendicular to the target line during the putting stroke.

U.S. Pat. No. 6,004,230 ("Hooker") discloses a method of training golf putting skills related to improving a pendulum-type swing for a golfer. The method includes positioning a light projecting apparatus on a golf putting club and projecting a beam of light from the apparatus onto a putting surface to form a line positioned transverse to the longitudinal direction of a golfer's feet and between the golfer's feet and the head of the golf putting club. A portion of the putting surface is selected as having an imaginary ball positioned thereon. A golfer then attempts to maintain the line of light generally parallel to a putting swing path and generally perpendicular to the longitudinal direction of the golfer's feet and performs a pendulum swing while observing the line of light.

U.S. Pat. No. 9,861,873 ("Davis") discloses training device to improve a golfer's putting ability. The device includes a guide rod supported by legs. An arm rotates about a longitudinal axis of the rod. The arm includes a targeting device (laser), which allows the golfer to align the training device and golf ball with the hole. The golfer establishes club head and ball position relative to the rod suitable to his/her putting stance and putter type. The device is aligned with the hole by moving the rod based on the direction of the light emitted from the laser. When properly aligned movement of the putter along the rod sends the ball towards the hole.

United States Pub. No. 2005/0261077 ("Kim") relates to an eye alignment apparatus for golf practice. The eye alignment apparatus comprises at least one eye leading means and a supporting means. The eye leading means allows a user to view a golf ball placed on the floor through each of sighting holes having different shapes or a straight sighting bar. In particular, the eye leading means is formed with a detachable fastening portion at an end thereof. Further, the supporting means is fixed to a support at an end thereof and formed with a fastening portion, which can be detachably mounted to any one of the eye leading means, at the other end thereof. The eye leading means and the supporting means may be detachably mounted to each other through a variety of fastening structures.

United States Pub. No. 2013/0231199 ("Stockton") teaches a putting training device having an elongate section with a ball receiving area and a visual target reference or aim point that is positioned in the desired direction of travel of the golf ball. The visual target reference is located a distance from the golf ball receiving area that is selected so that a golfer can focus on the visual target reference when making their swing, thus maintaining their attention on the desired direction of travel of the ball to improve their aim while still being able to see the orientation of the head of the putter during the latter portion of the golfer's stroke and as it hits the ball to be able to provide better club control during the putting swing.

United States Pub No. 2019/0255415 ("Helmker") discloses a training device for putting a golf ball. The training device includes an elongated plate. At least one anchoring member is secured to the elongated plate for anchoring the elongated plate, such as on a putting green. The device further includes an alignment guide configured to facilitate rolling of the golf ball along the elongated plate with a golf club.

United States Pub. No. 2022/0134207 ("Walker") discloses a golf putting training aid having a first stake coupled to a second stake by an upper alignment string and a lower alignment string that collectively establish parallel reference putting lines when the first and second stakes are deployed around a putting surface to train a golfer to properly align their eyes when executing a putt are disclosed.

The instant device includes a base that is connected to an adjustable structure which can be used to position a transparent target above the golf ball. The golfer can look through the target which includes a plurality of alignment marks. This allows the player to align their club and ball in the same position every time. The device provides feedback to the golfer. If the golfer moves their head during the golf shot, the ball will move out of the cross-hair sight lines of the target. The target can be customized with different sight lines based on the golfer's preference and type of golf shot to be practiced. For example, the target for putting can include a different sight line than the target designed for 7 iron improvement. The target can be adjusted to different heights and angles based on the golfers' height, vision preferences, and the angle of the putting surface. Thus, there is a need for devices used help a golfer align their eye with the ball and the club face in order to execute the optimum golf shot.

None of these known devices alone or in combination includes all the elements and features of the present invention, thus there is a need for novel devices and method that can be used to efficiently practice a golf stroke by assisting the golfer in alignment of their eye with the golf ball and without impacting the practice surface.

SUMMARY

In one aspect of the instant invention, a golf practice device includes a base. A target support structure including a groove is connected to the base. A positioner is connected to the target support structure and can slidably engage the groove to allow the positioner to be fixed in a plurality of vertical positions along the groove. The positioner can include at least one slot. A target including a bullseye can be mounted in the at least one slot. The golf practice device can be configured to a preselected position where a user's eye is substantially colinear with the bullseye and with a golf ball as seen by the user within the bullseye.

In one embodiment, an alignment bracket can be connected to the positioner to the target.

In some embodiments, the target is transparent or translucent and can include two spaced apart parallel lines containing the bullseye therebetween.

In certain embodiments, the bullseye includes bisecting perpendicular lines centered therein.

In other embodiments the positioner includes an inner portion and an outer portion. The outer portion can be frictionally engaged with the inner portion thereby allowing the outer portion to be fixed in a plurality of horizontal positions.

In some embodiments, the bullseye includes a circular portion. The circular portion can be sized to be substantially the diameter of a golf ball or about 1.68 inches. The circular portion can include four arced portions each having a line protruding therefrom and centered therein. The four arced portions can be about 90 degrees apart and can be centered about a central target point.

In yet other embodiments, the bullseye can include a circular portion. The circular portion can be sized to be substantially the diameter of a golf ball or about 1.68 inches. The circular portion can include four lines centered therein. The four lines can be about 90 degrees apart and can be centered about a vacant or transparent central target area.

In some embodiments, the bullseye includes a circular portion. The circular portion can be sized to be substantially the diameter of a golf ball or about 1.68 inches. The circular portion can include four arced portions centered therein. The four arced portions can be about 90 degrees apart and can be centered about an opaque central target point.

In certain embodiments, the target can include a single line. The single line can bisect a circular bullseye.

In some embodiments, the device can include a level or a laser. The level or laser can be mounted on the target.

In other embodiments, the target can include a longitudinal aperture. The longitudinal aperture can be used to fix the target in a plurality of positions using a fastener.

In certain embodiments, the target can include any one of a putter shape, an iron shape, or a wood shape. The target can include any one of a putter shape, an iron shape, or a wood shape. The shape can be positioned adjacent to the bullseye and substantially centered thereon.

In some embodiments, the target can include two spaced apart parallel lines containing the bullseye therebetween. The target can include any one of a putter shape, an iron shape, or a wood shape.

In certain other embodiments, the target can include a single line, the single line can bisect a circular bullseye. The target and can include any one of a putter shape, an iron shape, or a wood shape.

In some embodiments, a laser is mounted on the target and the base includes three legs forming a tripod.

In another aspect of the present invention, a method of practicing a golf stroke includes the steps of:

positioning a base on a practice surface;

adjusting a target support structure connected to the base and having a groove to a one of a plurality of vertical positions;

engaging a positioner having a slot slidably in the groove to fix the positioner in a plurality of vertical positions along the groove;

sliding a target into the slot into a preferred position for practicing a golf stroke, the target including a bullseye;

aligning a user's eye with the bullseye substantially colinear with a golf ball on the practice surface as seen by the user from above within the bullseye; and executing a preselected golf stroke while maintaining eye contact with the golf ball centered within the bullseye.

Of course it will be understood that the device can be adapted for use by a golfer of any dexterity, right or left handed.

DESCRIPTION OF THE DRAWINGS

The drawings show embodiments of the disclosed subject matter for the purpose of illustrating the invention. However, it should also be understood that the present application is not limited to the precise arrangements and specific instrumentalities shown in the drawings, wherein.

DETAILED DESCRIPTION

Figure 1:
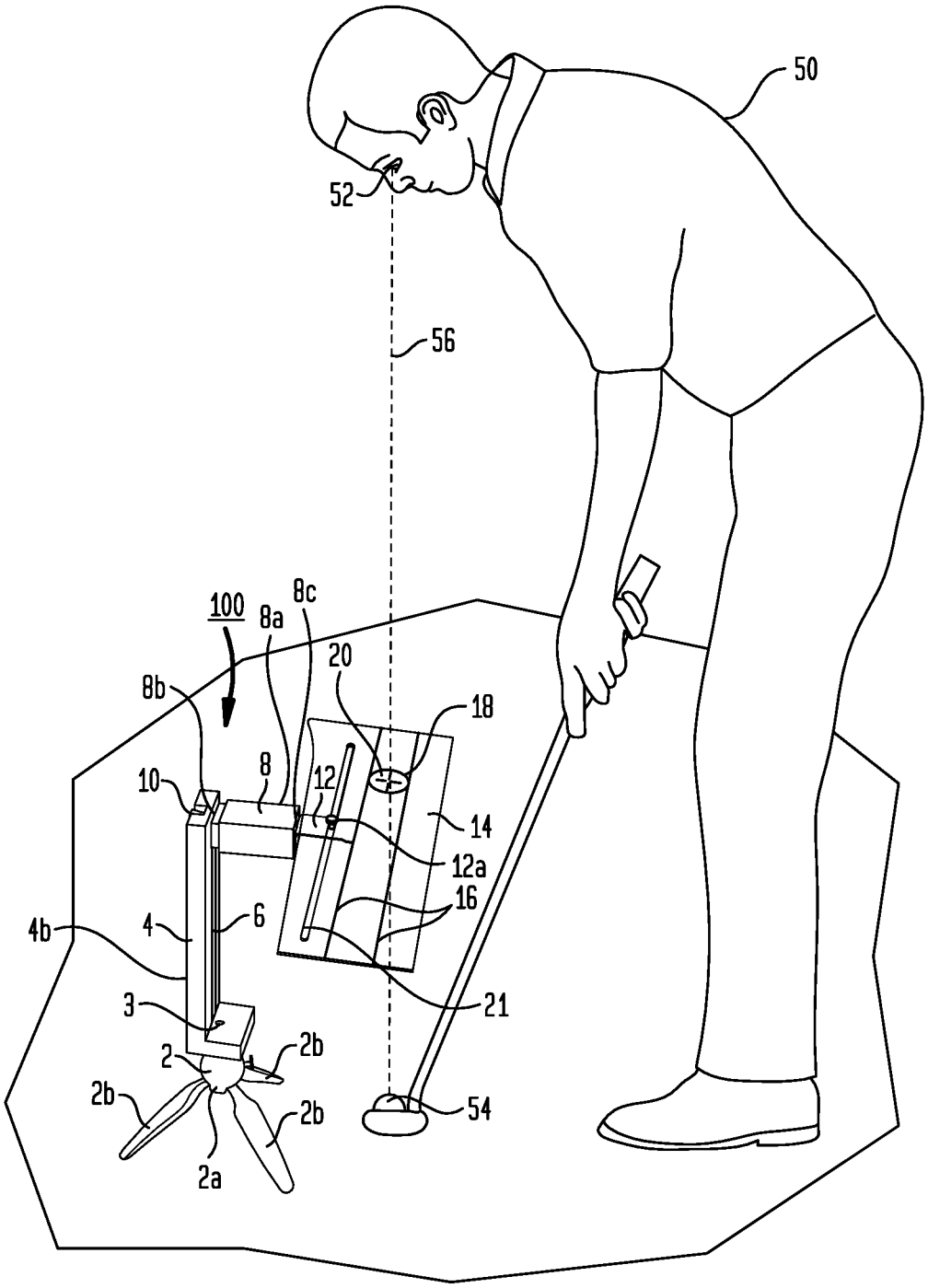
FIG. 1 is an isometric view of one embodiment on accordance with the present invention depicting in position for training a user.
Figure 2:
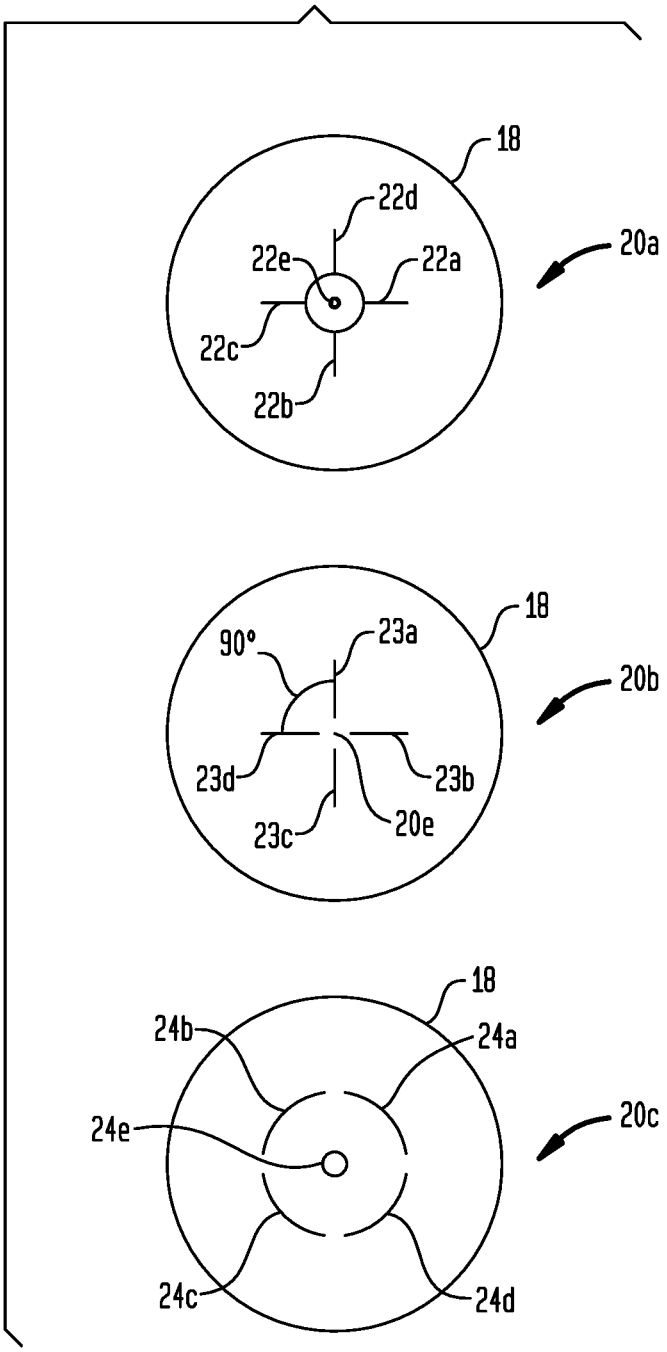
FIG. 2 is a plan view of some of the elements of the device of FIG. 1 in accordance with the present invention.

FIGS. 1-5 illustrate several exemplary non-limiting embodiments of golf practice device 100.

As depicted in FIGS. 1-5, the golf practice device 100 includes a base 2. The base 2 can include a central portion 2*a* having three legs 2*b* attached thereto in a tripod configuration (e.g., each leg 2*b* being about 120 degrees apart). Other configurations of the base 2 are contemplated to be within the scope of the invention. The base 2, can include any structure that supports the device in an upright position.

The base 2 can be attached to a target support structure 4 via a threaded rod or fastener (not shown) protruding from the base 2 which engages a threaded hole 3 in the target support structure. The support structure 4 includes an upright portion 4B which includes a groove 6. The groove 6 engages a positioner 8 which includes a thumb screw mechanism 10 for moving the positioner 10 to a plurality of vertical positions along the groove 6 and fixing it in place. In some embodiments, the positioner 8 can include an outer portion 8*a* and an inner portion 8*b*. The outer portion 8*a* being frictionally engaged with the inner portion 8*b*. The outer portion 8*a* can be moved relative to the inner portion 8*b* to a plurality of horizontal positions.

The distal end 8*c* of the positioner 8 is attached to a bracket 12. The bracket 12 is also attached to a target 14. The target 14 can be transparent and can include a pair of parallel lines 16, and a circular portion 18 including a bullseye 20 having perpendicular crossed lines 20*a*, 20*b* centered within.

In some embodiments, (See e.g., FIG. 5) the bracket 12 can be replaced by a slot or aperture 36 in the positioner 8. The slot 36 is sized to easily install or uninstall any target 14 without the need for tools, assembly, or disassembly.

In some embodiments the target can include a longitudinal aperture 21. The longitudinal aperture 21 can be used to adjust the target 14 in a plurality of positions using a fastener 12*a*.

The target 14 can be modified to include a plurality of designs. Several embodiments of the bullseye 20 are depicted in FIGS. 2 and 3*a*-3*c*. Bullseye 20*a* includes a circular portion 18. The circular portion 18 is sized to be substantially diameter of a golf ball or 1.68 inches. Centered within the circular portion 18 are four arced portions each having a line protruding there from 22 *a-d*, the arced portions 22*a-d*, are 90 degrees apart and centered about a central target point 22*e*.

Bullseye 20*b* includes a circular portion 18. The circular portion 18 is sized to be substantially diameter of a golf ball or 1.68 inches. Centered within the circular portion 18 are four lines 23 *a-d*, the lines 23 *a-b* are about 90 degrees apart and centered about a central target point 23*e*.

Bullseye 20*c* includes a circular portion 18. The circular portion 18 is sized to be substantially diameter of a golf ball or 1.68 inches. Centered within the circular portion 18 are four arced portions 24*a-d*, the arced portions 24*d-d*, are centered about 90 degrees apart and centered about a central target point 24*e*.

Figure 3A:
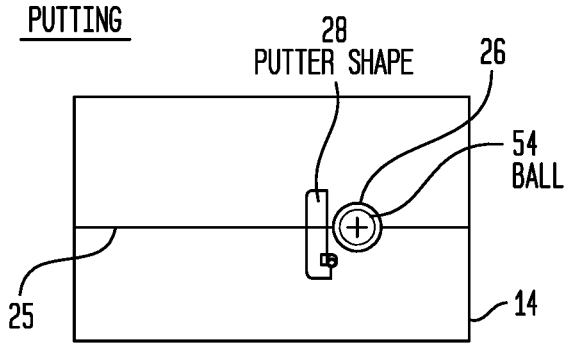
FIG. 3A is another plan view of some of the elements of the device of FIG. 1 in accordance with the present invention.
Figure 3B:
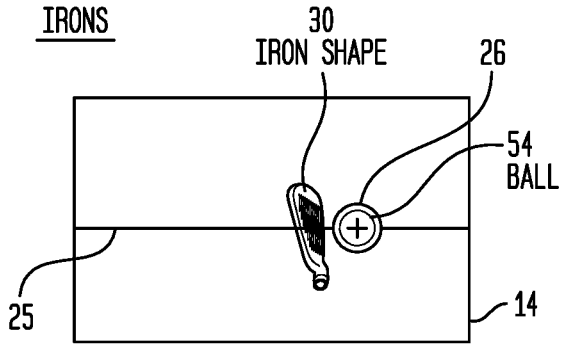
FIG. 3B is another plan view of some of the elements of the device of FIG. 1 in accordance with the present invention.
Figure 3C:
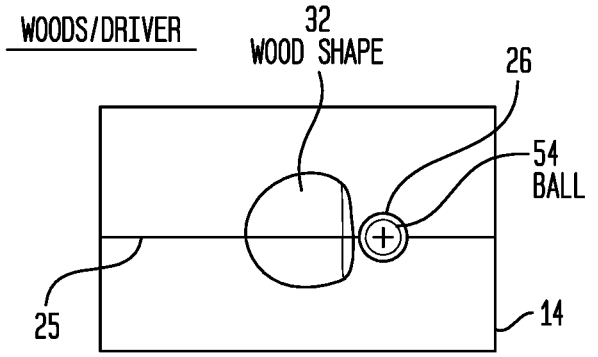
FIG. 3C is another plan view of some of the elements of the device of FIG. 1 in accordance with the present invention.

In some embodiments, the target 14 can include a single line 25 which bisects a circular bullseye 26. In addition, the target 14 can also include the shape of a club as shown in FIGS. 3*a-c*. For example, the target 14 in FIG. 3*a* includes the shape of a putter 28, the target 14 in FIG. 3*b* includes the shape of an iron or wedge 30, and the target 14 in FIG. 3*c* includes the shape of a wood or driver 32.

This provides flexibility and allows a user 50 to align their eye(s) 52 on a golf ball 54 by looking through the bullseye 20, 26 while positioning and aligning an appropriate club (e.g., a 7 iron) with the shape of the club 28, 30, 32 to be used (e.g., shape 30 for a 7 iron) as shown in FIGS. 3*a*-3*c*). By aligning a club to the shape 28, 30, 32 and the user's eye 52 to the golf ball 54 along sight line 56, proper alignment is achieved and the user 50 is positioned to execute a proper golf shot. The device 100 allows the user 50 to align a club and a golf ball 54 in the same position every time. The device 100 provides feedback to the user 50 whereby if the user 50 moves their head during the golf shot, the golf ball 54 will appear to move out of (off center to) the bullseye 20 in the target.

As described herein, the target 14 can be customized with different features based on the user's preference and the type of golf shot to be practiced. The target 14 can easily be adjusted to different positions and angles based on the user's height, vision preferences, and the desired shot or lie to be practiced.

Figure 4:
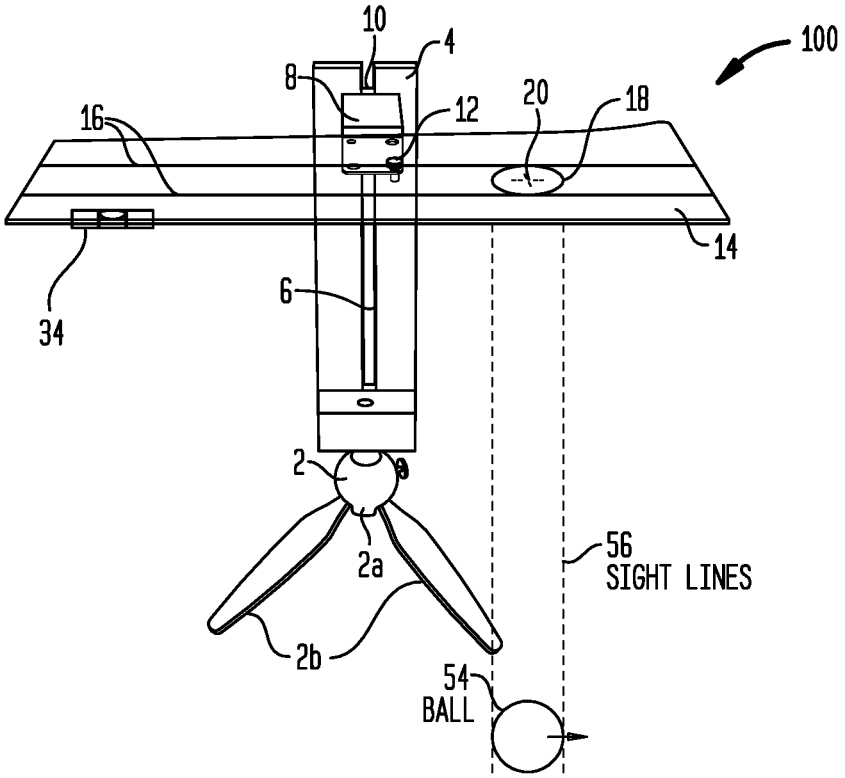
FIG. 4 is an isometric (front) view of some of the elements of the device of FIG. 1 in accordance with the present invention.
Figure 5:
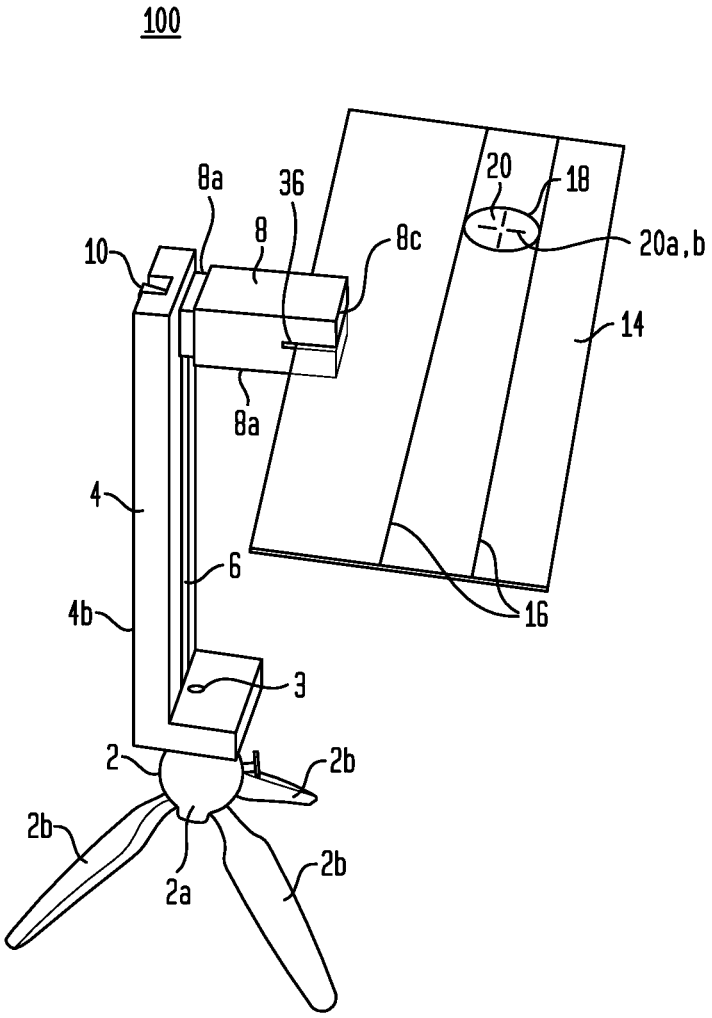
FIG. 5 is an isometric view some of the elements of an embodiment of the device of FIG. 1 in accordance with the present invention.

In some embodiments the target 14 can include a level and/or a laser 34. Any known level such as a bubble level or a digital level will suffice. As shown in FIG. 4, The level 34 can be attached to the target 14 in an area outside the bullseye 20 and target lines 16 to eliminate the possibility that the user's view of the ball is obstructed. The level 34 can be used to set the angle of the target 14 at any convenient angle, for example, the target 14 can be set to match the angle of the green or practice area in order to simulate a shot having the same lie or trajectory.

The laser 34 can be also be mounted (using a mirror, if necessary, not shown) to project a target line on a practice surface or on the ball 54. One or more lasers can also be employed to project a visible light beam on to the golf ball 54 in a spot or a particular pattern on the practice surface to help a user 50 spot the ball 54 and align the ball 54 with the target.

Although the present invention has been disclosed and described with reference to certain embodiments thereof, it should be noted that other variations and modifications may be made, and it is intended that the following claims cover the variations and modifications within the true scope of the invention.

What is claimed is:

1. A golf practice device comprising:

a base;

a target support structure, the target support structure including a vertical groove is connected to the base;

a positioner, the positioner is connected to the target support structure slidably engages the groove to allow the positioner to be fixed in a plurality of vertical positions along the vertical groove, the positioner including at least one slot;

a solid transparent or translucent target including a bullseye, the target being mounted in the at least one slot, wherein the golf practice device can be configured to a position where a user's eye is substantially colinear with the bullseye and with a golf ball as seen by the user within the bullseye.

2. The golf practice device of claim 1, further including an alignment bracket, the alignment bracket being connected to the positioner and to the target.

3. The golf practice device of claim 1, wherein the target includes two spaced apart parallel lines containing the bullseye therebetween.

4. The golf practice device of claim 1, wherein the bullseye includes bisecting perpendicular lines centered therein.

5. The golf practice device of claim 1, wherein the positioner includes an inner portion and an outer portion, the outer portion being frictionally engaged with the inner portion thereby allowing the outer portion to be fixed in a plurality of horizontal positions.

6. The golf practice device of claim 1, wherein the bullseye includes a circular portion, the circular portion being sized to be substantially the diameter of a golf ball or about 1.68 inches, the circular portion including four arced portions each having a line protruding therefrom centered therein, the four arced portions being about 90 degrees apart and being centered about a central target point.

7. The golf practice device of claim 1, wherein the bullseye includes a circular portion, the circular portion being sized to be substantially the diameter of a golf ball or about 1.68 inches, the circular portion including four lines centered therein, the four lines being about 90 degrees apart and centered about a vacant central target area.

8. The golf practice device of claim 1, wherein the bullseye includes a circular portion, the circular portion being sized to be substantially the diameter of a golf ball or about 1.68 inches, the circular portion including four arced portions centered therein, the four arced portions being about 90 degrees apart and centered about an opaque central target point.

9. The golf practice device of claim 1, wherein the target includes a single line, the single line bisecting a circular bullseye.

10. The golf practice device of claim 1, further including a level.

11. The golf practice device of claim 1, wherein the target includes a longitudinal aperture, wherein the aperture can be used to fix the target in a plurality of positions using a fastener.

12. The golf device of claim 1, wherein the target includes any one of a putter shape, an iron shape, or a wood shape positioned adjacent to the bullseye and substantially centered thereon.

13. The golf device of claim 3, wherein the target includes any one of a putter shape, an iron shape, or a wood shape positioned adjacent to the bullseye and substantially centered thereon.

14. The golf device of claim 9, wherein the target includes any one of a putter shape, an iron shape, or a wood shape positioned adjacent to the bullseye and substantially centered thereon.

15. The golf device of claim 1, wherein a laser is mounted on the target and the base includes three legs forming a tripod.

16. A method of practicing a golf stroke comprising the steps of:

positioning a base on a practice surface;

adjusting a target support structure to a first position, the target support structure including a vertical groove;

engaging a positioner having a slot slidably in the vertical groove to fix the positioner in a plurality of vertical positions along the groove;

sliding a solid transparent or translucent target into the slot into a preferred position for practicing a golf stroke, the target including a bullseye;

aligning a user's eye with the bullseye substantially colinear with a golf ball on the practice surface as seen by the user from above within the bullseye; and executing a preselected golf stroke while maintaining eye contact with the golf ball centered within the bullseye.

17. The method of claim 16, wherein the target includes two spaced apart parallel lines containing the bullseye therebetween.

18. The method of claim 16, wherein the bullseye includes bisecting perpendicular lines centered therein.

19. The method of claim 16, wherein the target includes any one of a putter shape, an iron shape, or a wood shape positioned adjacent to the bullseye and substantially centered thereon.

20. The method of claim 19, further including the step of aligning one of a putter, an iron, or a wood with a corresponding shape prior to executing the preselected golf stroke.

* * * * *